United States Patent [19]

Whitehurst et al.

[11] 4,374,725

[45] Feb. 22, 1983

[54] PROCESS FOR COAL LIQUEFACTION

[75] Inventors: Darrell D. Whitehurst, Titusville; Thomas O. Mitchell, Trenton; Malvina Farcasiu, Princeton, all of N.J.

[73] Assignee: Electric Power Research Institute, Palo Alto, Calif.

[21] Appl. No.: 903,912

[22] Filed: May 8, 1978

[30] Foreign Application Priority Data

Jun. 8, 1977 [GB] United Kingdom ..... 23952/77

[51] Int. Cl.[3] ..... C10G 1/00

[52] U.S. Cl. ..... 208/8 LE

[58] Field of Search ..... 208/8 LE

[56] References Cited

U.S. PATENT DOCUMENTS 3,663,420 5/1972 Jacobs et al. ..... 208/8 LE
3,841,991 10/1974 Cohen et al. ..... 208/8 LE
3,852,182 12/1974 Sze ..... 208/8 LE
3,997,425 12/1976 Gatsis et al. ..... 208/8 LE

FOREIGN PATENT DOCUMENTS 965720 4/1975 Canada ..... 208/8 LE
1287570 8/1972 United Kingdom ..... 208/8 LE

*Primary Examiner*—Delbert E. Gantz
*Assistant Examiner*—William G. Wright
*Attorney, Agent, or Firm*—Scully, Scott, Murphy & Presser

[57] ABSTRACT

In two stage solvent refining of coal by mixing comminuted coal with a solvent produced in the process under hydrogen pressure for initial solubilization and reacting the mixture under hydrogen pressure in a second stage, the overall process is improved by enriching the recycled solvent in hydroaromatic hydrocarbons of fourteen or less carbon atoms.

6 Claims, 2 Drawing Figures

PROCESS FOR COAL LIQUEFACTION

FIELD OF THE INVENTION

The invention concerns improvement in solvent refining of coal whereby components of coal suitable for fuel are extracted from comminuted coal by a solvent and recovered as a low melting point mixture of reduced sulfur and mineral matter content adapted to use as fuel in conventional furnaces. In the type of operation to which the invention is directed, the solvent is derived from the product extract and applied to the raw coal feed.

BACKGROUND OF THE INVENTION

The present emphasis on the conversion of coal to substitute solid and liquid fuels has led to several alternative processes which are now being considered. The end use of the resultant converted coal will primarily determine the degree of conversion that must be accomplished and the quality of the desired product. The optimal use of the coal will depend on the specific application.

Among the many processes presently being considered is the solvent refining of coal (SRC) in which coal is treated at an elevated temperature in the presence of a hydrogen-donor solvent and hydrogen gas in order to remove the mineral matter, lower the sulfur content of the coal, and to convert it into a low melting solid which can be solubilized in simple organic solvents. This SRC can also be upgraded through catalytic hydrogenation to produce a liquid of higher quality. These two processes are of concern to the present invention.

Little is known at present as to the exact mechanisms by which the coal is transformed into soluble form, or of the detailed chemical structure of the soluble product or even the parent coal. It is known that many coals are easily solubilized and for others solubilization is more difficult. Some correlations have been made between the rank of the coal and ease of solubilization and product yield. A somewhat better correlation has been found with the petrography of the coal. Little is known about the relationships to product quality.

The initially dissolved coal (SRC) may have utility as a substitute clean fuel or boiler fuel; however, for substitute fuels of higher quality, specifications on viscosity, melting point, ash, hydrogen, and sulfur contents are much more stringent. Attempts to meet these specifications by operating the SRC process more severely have met with many difficulties such as low liquid yields, high hydrogen consumption, difficulty of separating unreacted residue, and excessive char formation, which often completely plugs process transfer lines and reactors.

Alternative methods of improving specifications through catalytic hydrogenation are also difficult. The problems which arise are threefold: (1) SRC components are susceptible to further condensation and may deposit as coke on catalysts used for their conversion, (2) they can also foul the catalysts by physical blockage as their size approaches the pore size of conventional catalysts and (3) they may contain metal contaminants, and their highly polar nature (particularly nitrogenous and sulfur compounds) can lead to selective chemisorption, and thus poison the catalysts.

The precise chemical nature of the SRC is still unknown; generally its composition is discussed in terms of solubility. Several classifications are commonly used.

These include oils which are hexane or pentane soluble, asphaltenes which are benzene soluble, and pyridine soluble-benzene insoluble materials. Of these the asphaltenes and pyridine soluble-benzene insoluble materials are believed to be responsible for high viscosity, solvent incompatability, and processing difficulties. Little is known about the pyridine soluble-benzene insoluble materials. These have been referred to as "pre-asphaltenes" which implies that asphaltenes are derived from them; however, this has yet to be established.

More information is available on the nature of asphaltenes. It is common experience that coal liquids contain large quantities of materials known as asphaltenes. In fact, it has even been suggested that the formation of asphaltenes is a necessary step in the liquefaction of coal.

The term asphaltene is a rather nebulous and all-inclusive classification of organic materials for which a detailed chemical and physical identification is quite difficult, and has not yet been accomplished.

This classification generally refers to high molecular weight compounds, boiling above 650° F., which are soluble in benzene and insoluble in a light paraffinic hydrocarbon (e.g., pentane). Usually no distinction is made regarding polarity, as the term has been used customarily in the characterization of heavy petroleum fractions (resids, etc.) where the amount of highly polar materials is small. However, in coal liquids this may not necessarily be the case due to the high degree of functionality of coal itself. Thus, coal liquids of low molecular weight may still be "asphaltenes." There is considerable variation in the molecular weight of solubilized coals which arises from differences in the parent coals, or different solvent or solvent-reactant systems at the same temperature of reaction. This could well be related to colloidal properties of coal liquids. It is well documented that asphaltenes found in heavy petroleum fractions are colloidal in nature.

Some comments on the chemical nature of coal asphaltenes have recently been made. Asphaltenes from Synthoil Process liquids were separated into a basic fraction (containing oxygen only as ether or ring oxygen and basic nitrogen as in pyridine) and an acidic fraction (containing phenolic OH and nitrogen as in pyrrole). The two fractions were found to have very different properties. The basic fraction could be hydrotreated only with difficulty, while the acid fraction underwent facile hydrotreating. This is consistent with reported data on the influence of nitrogen heterocycles on conventional hydroprocessing.

Based on these results an acid-base pair structure for asphaltenes was proposed and this structure was extrapolated to that of coal itself. This structure is quite different from the more amphoteric nature of coal which has been proposed previously.

Mechanisms have been proposed for the noncatalyzed formation of asphaltenes from coal. In this work it was concluded that asphaltenes were a *necessary* product of coal liquefaction and that oils were derived from asphaltenes. The more polar pyridine soluble materials were not investigated and were assumed to be equivalent to unreacted coal. The maximum yield of asphaltenes was found, however, to be a function of the conditions of coal conversion; hydrogen donor solvents greatly reduced the propensity for formation of asphaltenes at low conversion. In addition, it was not determined whether the asphaltene fractions resultling from different conditions were of the same chemical and/or physical nature. Thus, asphaltenes may be inherent constituents of coal products or they could well be the result of either thermal or catalytic transformations of more polar materials.

In considering what may be involved in the formation of asphaltenes during coal solubilization or conversion, it may be instructive to consider what is known of coal structure. Coal is a rather complicated network of polymeric organic species, the bulk of which is porous in the natural form; the pore system varies from coal to coal. Depending upon the specific nature of the porous structure of each coal, its chemical constituents, and the reaction conditions, the rate of diffusion and mass transport of organic molecules through the pores could have a strong effect on the rates of dissolution, hydrogen transfer, and hydrogenation and hydrocracking reactions, and thus on the ultimate yield of soluble product.

As the rank of coal becomes higher, an increasing number of colloidal size aggregates (20–50 Å) can be observed by X-ray scattering and diffraction.

If, in the early stages of the dissolution of coal these colloidal aggregates dissociate to some degree and go into solution, the molecular weight of the lowest unit appears to be consistent with the lowest molecular weights observed in solubilized coals (~500 MW). This comparison may be coincidental, however. Unfortunately, in order to dissolve coal it is generally found that temperatures in excess of 300° C. are necessary. It is also known that coal begins to pyrolize and evolve volatile matter at temperatures as low as 250° C. (depending on rank), and by 350° C. considerable material has evolved. This strongly suggests that extensive internal rearrangement of the coal occurs during the dissolution process. Rearrangement can include hydrogen migration to produce highly condensed aromatic rings as well as further association of small colloidal aggregates or condensation of reactive species. Major physical changes in the pore system of the solid coal have also been reported.

This rearrangement could possibly be responsible for some of the very high molecular weights (~3000 MW) observed with some solvents. No detailed relationships of solvent type and/or reaction condition to the molecular weight distribution of solubilized coal has yet been established. Similarly, the possibility of reversible molecular weight changes, due to recondensation causing increased molecular weights at various temperatures, has not been investigated thoroughly.

An alternative route to high molecular weight is through the catalytic influence of inorganic coal minerals which are present in the processing of coal. It is known that some coals are more reactive than others, producing higher yields of liquid products at shorter residence times. It is believed that this is due to the fact that the initial coal products are reactive and condense to char unless proper reaction conditions are established. This further condensation could well be a catalytic phenomenon induced by intrinsic coal minerals.

Another more subtle consequence of certain inorganic constituents is their influence on the physical properties of pyrolytic coal chars, and thus on the diffusional properties imposed on reactive intermediates. The volume of char has been observed to vary by a factor of four or more, with little change in weight, by varying the type of inorganic contaminants in a given bituminous coking coal. The pore system of the resultant chars must be vastly different and changes of this type magnitude in the physical structure of the coal or char could greatly influence mass transport of intermediates produced within the pore system. Mass transfer limitation during the pyrolysis and hydrogasification of some coals at high temperatures has recently been established. This study showed that for some coals, reactive primary products are formed which can recombine to produce char if the conditions are not properly adjusted. The criticality was found to be the rate of diffusion of the reactive species out of the coal relative to its rate of conversion to char.

At lower temperatures, the rates of reaction are, of course, slower and thus less susceptible to mass transport limitations. However, the imposition of a liquid phase, commonly used in liquefaction processes, may greatly enhance diffusional restrictions. Recent model studies conducted in aqueous systems, have shown that restriction of diffusion through porous structures with pore radii ranging from 45 Å to 300 Å for even relatively small solute molecules is very significant.

At the present stage of the art, the accumulated information is largely empirical, with little basis for sound extrapolation to predict detailed nature of solvent and processing conditions for optimum yield and quality of solvent refined coal. It is recognized that the poorly understood asphaltenes are probable sources of many of the problems encountered, e.g. formation of char at processing conditions conducive to efficient separation of mineral matter (ash) and sulfur from desired product at high yield.

In the process of converting coal to a low sulfur, low melting solid by use of recycled product fractions as solvent, several reaction steps occur. Generally coal is admixed with a suitable solvent recycle stream and hydrogen and the slurry is passed through a preheater to raise the reactants to a desired reaction temperature. For bituminous coal, the coal is substantially dissolved by the time it exits the preheater. Sub-bituminous coals can be dissolved but care must be exercised not to raise the temperature too high and thus promote charring.

The products exiting from the preheater are then transferred to a larger backmixed reactor where further conversion takes place to lower the heteroatom content of the dissolved coal to specification sulfur content and melting point. The geometry of this reactor is such that the linear flow rate through it is not sufficient to discharge a substantial quantity of particulate matter of a desired size. Thus the reactor volume becomes filled (at steady state) up to about 40 vol % by solids which are produced from the coal. These solids have been shown to be catalytic for the removal of heteroatoms and the introduction of hydrogen into the coal products and solvent. The products exiting the reactor are initially separated by flash distillation, which depressurizes the stream and removes gases and light organic liquids. The products are further separated (filtration, centrifugation, solvent precipitation, etc.) and the filtrate is distilled to recover solvent range material (for recycle) and the final product SRC.

SUMMARY OF THE INVENTION

Under typical conditions presently practised, we have found that the recycle solvent contains a mixture of hydroaromatic compounds (hydrogen donors) and condensed aromatic compounds in which the hydroaromatics are below the thermodynamic ratios allowed under the conditions of the reactions (about 2000 psi $H_2$ and 400°–450° C.). Phenols are also present in the recycle solvent, with certain consequences.

These hydroaromatics achieve a steady state concentration which is dictated by the rate of hydrogen consumption (by hydrogen donation to coal) and the rate of rehydrogenation of condensed aromatics (catalyzed by reactor solids). In the preheater only hydrogen consumption occurs. In the reactor both hydrogen consumption and rehydrogenation occur but apparently in existing processes the rehydrogenation step is slow; thus, thermodynamic equilibrium is not established. We have found that the major contributors to hydrogen donation are partially hydrogenated aromatic hydrocarbons (e.g. tetralin, dihydrophenanthrene) and partially hydrogenated aromatic phenols (ethers can also be present).

The concentration of hydrogen donors in the solvent thus varies in the solvent depending on its particular location in the process.

We have also found that the major contributors to the hydrogen donor capacity of typical recycle solvents are hydroaromatic hydrocarbons having fewer than about fourteen carbon atoms, in particular tetralin and methyltetralins and hydrophenanthrenes.

Based on these observations we propose an improved coal liquefaction process in which the hydrogen donor capacity of a given solvent is maintained at a higher steady state level than is presently practiced. This is done by merely adding a light hydroaromatic feed to the recycle stream after a standard steady state condition has been achieved (including buildup of catalytic reactor solids). This higher level of hydrogen donor capacity will be sustained as any hydrogen consumed will be replaced through the catalytic action of the reactor solids.

The regenerated light hydroaromatics are recoverable by proper maintenance of the flash separator temperature and by a second condenser (cold separator). These recovered light hydroaromatics are then recombined with heavier recycle solvent streams and admixed with fresh coal feed.

The only perturbation of this capacity which might occur would be due to the production of the same specific components (hydroaromatics and aromatics) from the coal itself or the conversion of hydroaromatics to lower molecular weight species. Our experience indicates that these two processes are relatively slow, but if the hydrogen donor capacity does approach a lower value occasionally the light hydroaromatic stream can be catalytically upgraded in a separate reactor.

One advantage to this process is that catalytic regeneration need only be done occasionally on small streams. The overall solvent properties (polycondensed aromatics and phenols) will not be changed by this process. Thus, the solvent will be capable of dissolving even the most polar SRC's. The SRC product quality will be improved under set reaction conditions as the solvent will be more reactive. Alternatively, the process flow rate can be increased. Another advantage of this process is that the tendency of the SRC product to form char through competitive regressive reactions will be dramatically reduced. The process can further be improved by removal of phenols from the solvent.

The fact that reactor solids catalytically regenerate the solvent is known. There has already been proposed a process which continuously regenerates a hydrogen rich solvent through catalytic hydrogenation externally. That process, however, because of the requirement of severe solvent rehydrogenation, produces a solvent which has poor solubility properties for SRC and excessive amounts of hydrogen are consumed merely to dissolve the coal. A further proposed process (H-Coal) employs a catalyst present in the reactor, which catalyst, however, is an expensive commercial catalyst that loses activity due to poisoning by coal inorganic constituents and must continuously be replaced by fresh catalyst.

By contrast, the present invention requires only occasional rehydrogenation of a small portion of the solvent and little, if any, catalyst deactivation occurs as the stream being processed is free of inorganic contaminants. The solvent properties of the recycle solvent of this invention are much superior to those of the prior proposals and even highly polar SRC's can be dissolved. In sum, the present invention allows much more flexibility in the SRC process with less tendency for char formation and a more reactive solvent which can lead to smaller reactors and lower capital costs. The overall hydrogen consumption for a given SRC product specification may also be reduced.

BRIEF DESCRIPTION OF THE DRAWINGS

These and other objects and advantages will be more fully understood from description below of preferred means contemplated by us for putting our invention into effect as illustrated by the annexed drawings wherein.

DESCRIPTION OF SPECIFIC EMBODIMENTS

The process of the invention applies several findings derived from study of solvents in solvent refining of coal. The term "solvent" is used here because of custom in the art despite the fact that the liquid applied in solvent refining of coal performs important functions in the chemical reactions involved in addition to the physical function of dissolving components of the coal charged to the system and maintaining as solutes the products of chemical conversion arising in the process. In fact, high solvent power for the ultimate SRC product is not an adequate indicator of suitability for use as solvent applied to the coal charged to the process. As the process proceeds, the chemical character of the solute changes by removal of polar groups and the product takes on a greater degree of hydrocarbon nature.

In order to be commercially attractive, the process must provide solvent as a recycle product of the solvent refining process. We have found that these considerations are satisfied to better effect by enhancing the proportion of hydrogen donors constituted by partially hydrogenated polycyclic aromatic hydrocarbons of about fourteen or less carbon atoms such as tetralin, methyl tetralins, hydrophenanthrenes and the like. To accomplish this result, this invention provides for enriching the recycle solvent in such compounds. One method contemplated is to add these desirable compounds from a source external to the process. An alternative technique is separation of these compounds from the reaction products and blending the same with heavier recycle solvent removed at a later stage. The light fraction may be subjected to catalytic hydrogenation before blending with the heavy fraction and may be blended in desired proportions to suit needs of the process dictated by nature of the coal under treatment and the projected end use of the product. The novel technique permits control of the degree of hydrogen donor components. If too much hydrogen is added back to the solvent it becomes deficient in aromatic content and the coal products become insoluble.

Figure 1:
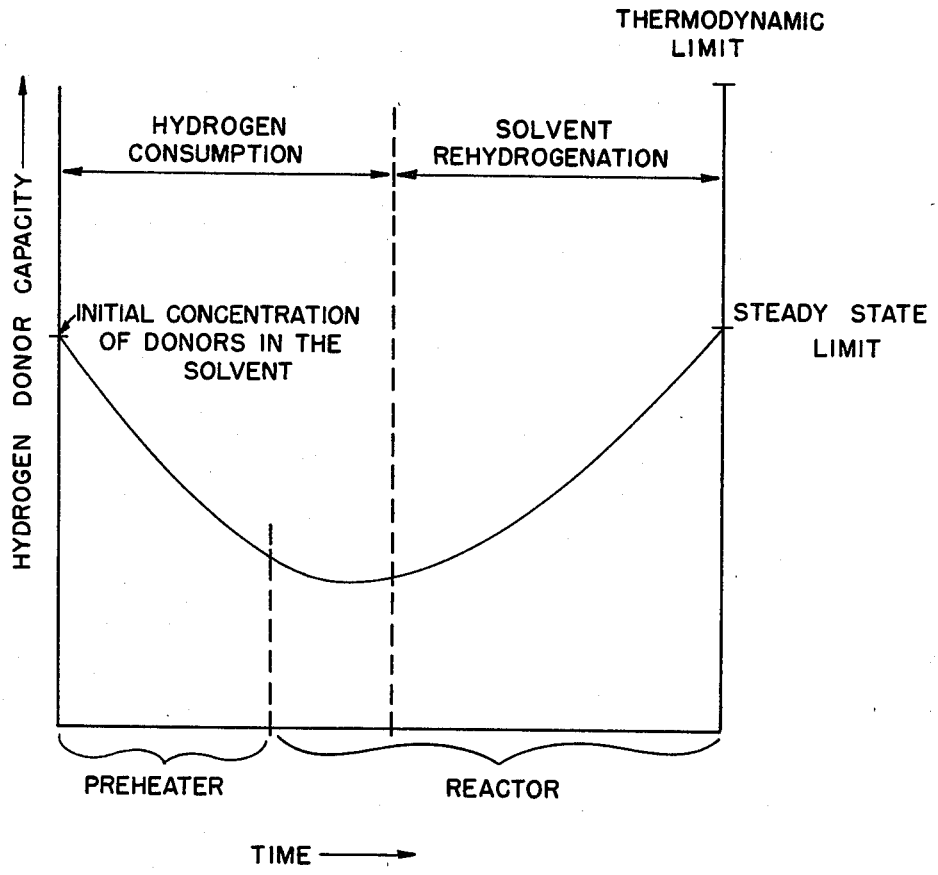
FIG. 1 is a graphical representation of hydrogen donor capacity of the solvent in SRC processing.

The nature of changes in hydrogen donor content of the solvent is set out in the graph constituting FIG. 1 of the drawings. The graph contemplates a process in which coal and recycle solvent are preheated under hydrogen pressure and passed to a back mixed reactor containing mineral solids derived from coal which is also under hydrogen pressure.

It is typical of such processes that the ratio of hydrogen donors to corresponding aromatics (e.g. tetralin/-napthalene) is significantly below the thermodynamic limit imposed by conditions at thermodynamic equilibrium of hydrogen, hydrogen donor and aromatic hydrocarbon. As shown at the left-hand side of the graph, solvent enters the preheater at the steady state limit on hydrogen donors. Hydrogen donor content drops rapidly through the preheater and on into the reactor as the donors are stripped of hydrogen to satisfy demands by coal fragments for the hydrogen which inhibits polymerization and formation of insoluble char. In the reactor, polycyclic aromatics are hydrogenated to regenerate donors under the catalytic effect of the accumulated solids. During an initial period in the reactor, donor content continues to decline as the demand for transferred hydrogen exceeds the rate of rehydrogenation of polycyclic aromatics. As that demand drops, rehydrogenation becomes the dominant reaction with rise of hydrogen donor content to the steady state limit at time of discharge from the reactor.

Figure 2:
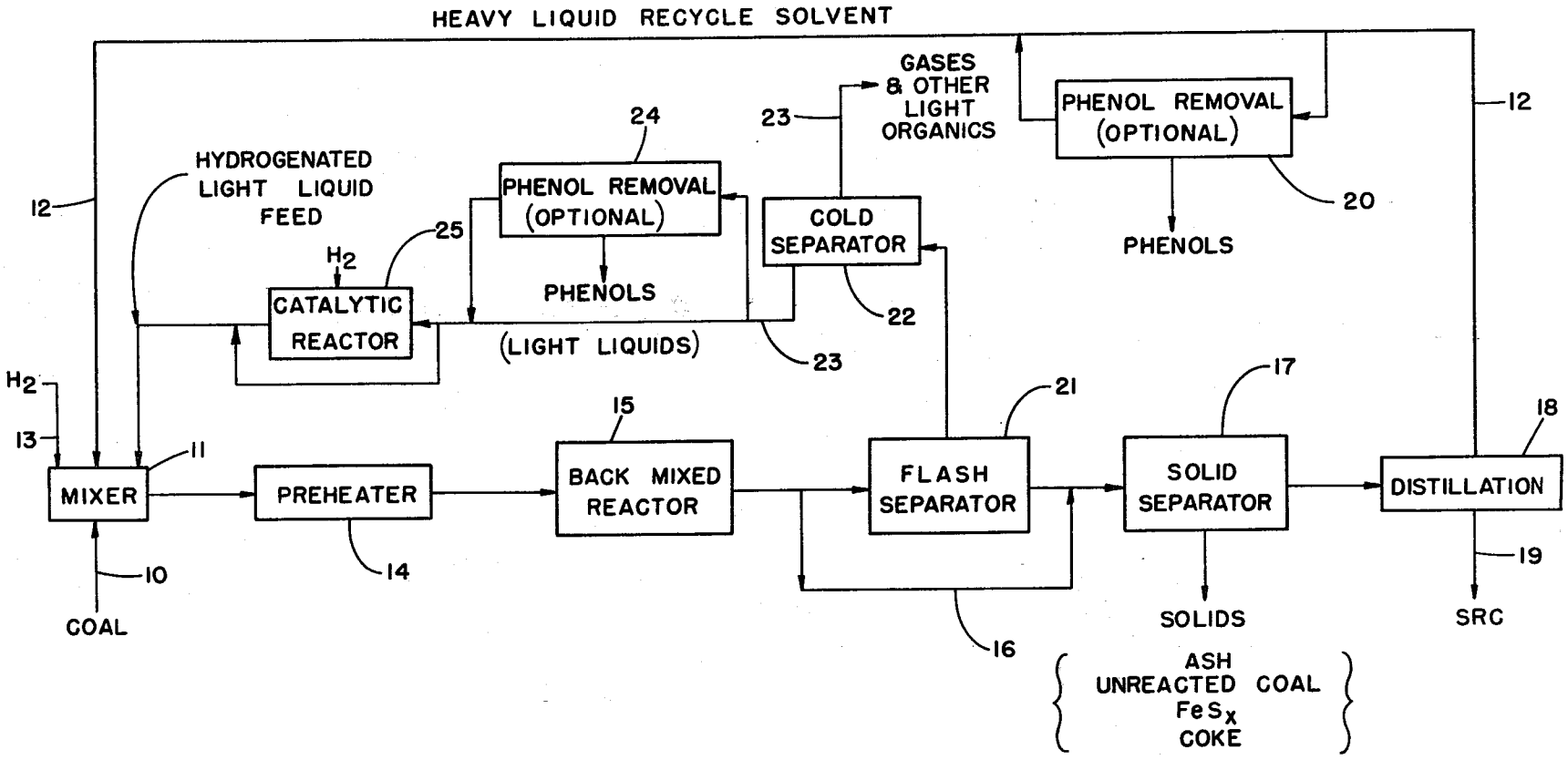
FIG. 2 is a diagrammatic flow sheet illustrative of best modes contemplated by us of carrying out our invention.

The invention as illustrated by FIG. 2 is preferably applied after steady state has been achieved by a system of the type described, although it may be applied continuously beginning on start-up. A typical operation may consist in solvent refining of Monterey Mine Illinois #6 coal on which inspection data are shown in Table 1.

TABLE I

| Name of Coal | Illinois #6 |
|---|---|
| Mine | |
| Location | |
| State | Illinois |
| County | Macoupin |
| Seam | 6 |
| Name of Mine | Monterey |
| Proximate Analysis* | |
| % Moisture (as rec.) | 12.81 |
| % Ash (as rec.) | 9.43 |
| % Volatile Matter | 41.73 |
| % Fixed Carbon | 47.45 |
| BTU (as rec.) | 10930. |
| BTU | 12536. |
| Free Swelling Index | |
| Ultimate Analysis* | |
| % C | 69.72 |
| % H | 4.98 |
| % O** | 8.20 |
| % N | 1.08 |
| % S (total) | 5.14 |
| % S (pyritic) | 2.26 |
| % S (organic) | 2.70 |
| % S (sulfate) | 0.18 |
| % Cl | 0.06 |
| % Ash | 10.82 |
| Petrographic Analysis | |
| Vitrinite | 89 |

TABLE I-continued

| | |
|---|---|
| Pseudo-vitrinite | 3 |
| Exinite | 1 |
| Fusinite | 1 |
| Semi-fusinite | 1 |
| Massive Micrinite | 2 |
| Granular Micrinite | 2 |
| Resinite | 1 |
| Total | 100 |
| Mean Maximum Reflectance in Oil (564 nm): 0.47% | |

*All analyses are given on a dry weight basis unless otherwise stated.
By difference That coal, crushed to pass 100–200 mesh standard sieve having a maximum particle dimension of about 0.15–0.07 mm. is admitted by line 10 to mixer 11 where it is mixed with 1 to 6 parts by weight of recycle solvent from line 12 and hydrogen from line 13. Alternately hydrogen can be added only to the backmixed reactor 15. The mixture passes to and through a preheated 14 where it is brought to a temperature of 350°–480° C. during a transit time of 1–10 minutes. Components of the coal are largely taken into solution in preheater 14 and the reactions characteristic of the process are initiated, with resultant depletion of donor hydrogen. The reaction mixture is transferred to back mixed reactor 15 operated to retain undissolved coal solids to the extent of up to 40% of the reactor volume. Residence time of the reaction mixture in reactor 15 is about 20–120 minutes average while the reaction of dissolved coal proceeds in known manner concurrently with hydrogenation of polycyclic aromatic compounds to regenerate hydrogen donor capacity at temperature of 300°–460° C. and 500–3000 psig. During initial operation the flash separator 21 does not have to be used to full capacity and a portion of the effluent of reactor 15 is conducted through by-pass line 16 to solids separator 17 for removal of ash, unreacted coal, iron sulfides, coke and the like by filters, centrifuges, precipitation or other appropriate means. The clarified liquid passes to distillation facility 18 for recovery of solvent refined coal (SRC) by line 19 free of recycle solvent which is returned by line 12 to mixer 11 as described above. A portion or all of the recycle solvent may be diverted through phenol extractor 20** for separate recovery of phenols, e.g. by caustic wash.

The described operation conforms generally to known practice and is conducted for a period adequate to achieve steady state (say 20 to 200 hours) as shown by constant composition of recycle solvent and SRC. Upon reaching steady state, the full effluent of reactor 15 is diverted to flash separator 21 where reduction of pressure to about 15–150 psig causes evaporation of compounds having fourteen carbon atoms or less. That vapor phase fraction is cooled to about 180°–350° C. at 15–150 psig and passed to cold separator 22 from which normally gaseous compounds, boiling below about 20° C. are removed by vent 23 for use as fuel or other purpose. Light liquids withdrawn by line 23 from separator 22 are recycled to mixer 11 in a ratio to heavy liquid recycle solvent from line 12 such that total recycle solvent to mixer 11 contains a proportion of hydrogen donors having fourteen or less carbon atoms greater than the prior steady state operation with return of a single recycle solvent stream.

A portion or all of the light recycle in line 23 may be diverted through phenol removal facility 24 for recovery of product phenols, to adjust solvent properties and the like. Adjustment of hydrogen donor content may be achieved by diversion of the light solvent recycle in whole or part, continuously or intermittently through catalytic hydrogenation reactor 25.

If monophenols are to be preserved in external hydrogenation, then a second distillation may have to be done to remove and separately recycle them. This could be done by an intermediate distillation at ~210° C. (This saves cresol but would bypass tetralin/napthalene which would still be hydrogenated.)

It will be apparent that increase of the content of hydrogen donors containing fourteen or less carbon atoms may be achieved by adding such compounds from an external source instead of or as a supplement to the technique described above, and such operation is contemplated within the scope of the invention.

As well known in the art, coals vary in composition and require varied conditions for optimal production of SRC. In general, the invention contemplates use of solvent in the range of 1 to 6 parts of solvent per part of coal by weight. In the mixer, coal and solvent will optionally be mixed with 5 to 50 standard cubic feet of hydrogen per pound of coal then heated in the preheater for 1 to 10 minutes to a temperature in the range of 350° C. to 460° C. Alternatively the hydrogen can be added directly to the back mixed reactor. In reactor 15 the mixture is held for a period of 20 to 120 minutes at 350° C. to 460° C. and 500 to 3000 psig. The recycle solvent is separated as a fraction of the reaction products having a boiling range of 190° C. to 500° C. and a quantity which will satisfy the needs of the reaction stage when admixed with an amount of light recycle solvent adequate to give the described ratio of fourteen or less carbon atom donors.

We claim:

1. In a process for solvent refining coal by heating a mixture of comminuted coal and a steady state recycle solvent containing hydrogen donor components and derived as hereinafter recited, maintaining the said mixture under hydrogen pressure at reaction conditions for solubilization of coal components, separating undissolved solids from the resultant reaction products and separating solvent refined coal product from a recycle solvent fraction boiling in the range of about 190° C. to about 500° C. for mixture with coal as aforesaid; the improvement for control of the degree of hydrogen donor components in said recycle solvent which comprises separating from the said reaction products a fraction containing the compounds having fourteen carbon atoms or less, removing normally gaseous compounds from said fraction to provide a light liquid fraction, and blending said light liquid fraction with said recycle solvent fraction in a ratio such that the blend contains an enhanced proportion of hydrogen donors having fourteen or less carbon atoms.

2. A process according to claim 1 wherein said light hydrogen donor components are constituted by a fraction consisting essentially of compounds of fourteen or less carbon atoms separated from said reaction products and subjected to partial catalytic hydrogenation.

3. A process according to claim 1 wherein phenols are separated from said recycle solvent fraction before mixture with said coal.

4. A process according to claim 1 wherein said separation of undissolved solids from the reaction products is conducted after separation therefrom of said fraction containing compounds having fourteen carbon atoms or less.

5. A process according to claim 1 wherein said separation of undissolved solids from the reaction products is conducted after separation therefrom of said fraction containing compounds having twelve carbon atoms or less.

6. A process according to claim 2 wherein the separation and partial catalytic hydrogenation of said fraction consisting essentially of compounds of fourteen or less carbon atoms is conducted intermittently.

* * * * *

UNITED STATES PATENT AND TRADEMARK OFFICE

CERTIFICATE OF CORRECTION

PATENT NO. : 4,374,725

DATED : February 28, 1983

INVENTOR(S) : Whitehurst, et al.

It is certified that error appears in the above-identified patent and that said Letters Patent is hereby corrected as shown below:

Column 10, line 29, cancel beginning with "5. A process" to and including "having twelve carbon atoms or less" in Column 10, lines 32-33 and insert the following claim:

5. A process according to Claim 2 wherein said fraction consisting essentially of compounds of fourteen or less carbon atoms is processed for separation of phenols therefrom before mixture with said coal.

Signed and Sealed this

*Seventh* Day of *August 1984*

[SEAL]

*Attest:*

GERALD J. MOSSINGHOFF

*Attesting Officer*

*Commissioner of Patents and Trademarks*